US006160256A

United States Patent [19]

Ishihara

[11] Patent Number: 6,160,256

[45] Date of Patent: Dec. 12, 2000

[54] TIME-OF-FLIGHT MASS SPECTROMETER AND MASS SPECTROMETRIC METHOD SING SAME

[75] Inventor: Morio Ishihara, Osaka, Japan

[73] Assignee: JEOL Ltd., Tokyo, Japan

[21] Appl. No.: 09/130,045

[22] Filed: Aug. 6, 1998

[30] Foreign Application Priority Data

Aug. 8, 1997 [JP] Japan ..... 9-214385

[51] Int. Cl.[7] ..... H01J 49/40

[52] U.S. Cl. ..... 250/287; 250/282

[58] Field of Search ..... 250/287, 282

[56] References Cited

U.S. PATENT DOCUMENTS 5,396,065 3/1995 Myerholtz et al. ..... 250/287

OTHER PUBLICATIONS

"analysis" Encyclopedia Britannica Online <http:www-w.search.eb.com/bol/topic?eu=120669&sctn=9&pm-1>.

*Primary Examiner*—Jack Berman

*Attorney, Agent, or Firm*—Webb Ziesenheim Logsdon Orkin & Hanson, P.C.

[57] ABSTRACT

There is disclosed a time-of-flight (TOF) mass spectrometer capable of making a spectral measurement quickly and efficiently and making effective use of ionized samples. The instrument has a pulse-generating portion for producing appropriate pulse sequences. An arithmetic unit Fourier-transforms a resultant spectrum from a detector to find W(ω). The arithmetic unit Fourier-transforms a pulse sequence signal from the pulse-generating portion to find H(ω). The arithmetic unit calculates Y(ω)=W(ω)/H(ω) and takes the inverse Fourier transform of the calculated Y(ω).

4 Claims, 1 Drawing Sheet

TIME-OF-FLIGHT MASS SPECTROMETER AND MASS SPECTROMETRIC METHOD SING SAME

FIELD OF THE INVENTION

The present invention relates to a time-of-flight (TOF) mass spectrometer and to a mass spectrometric method using a TOF mass spectrometer.

BACKGROUND OF THE INVENTION

In time-of-flight (TOF) mass spectrometry, ions are mass-analyzed according to times of transit of ions, i.e., times required for ions to traverse a given length of passage. In TOF mass spectrometry, an assemblage of ions are accelerated with a given accelerating voltage from an ion source. These ions are emitted as pulses in a short time. Since a uniform accelerating energy is applied, ions of greater masses show smaller flight velocities. Ions of smaller masses exhibit greater flight velocities.

The assemblage of ions going out of the ion source with flight velocities according to mass are spatially dispersed according to flight velocity while traveling through a field-free drift region.

Ions having the minimummass of these ions first impinge on a detector Then, ions of greater masses sequentially reach the detector. The intensities of ions detected by the detector are recorded as a function of the elapsed time from the emission from the ion source. Thus, mass spectral information (hereinafter referred to simply as spectra) is obtained.

Where a mass analysis is performed using such a TOF mass spectrometer, ions should be ejected from the ion source at short intervals of time in order to make effective use of the ionized sample Consequently, more ions can be extracted within a limited time and mass-analyzed.

In TOF mass spectrometry, ions of smaller masses sequentially impinge on the detector and so if the ions are ejected at too short intervals of time, ions of smaller masses ejected later get ahead of previously ejected ions of greater masses and arrive at the detector. As a result, overlap of spectra takes place.

SUMMARY OF THE INVENTION

The present invention is intended to solve the foregoing problem.

It is an object of the present invention to provide a time-of-flight (TOF) mass spectrometer and TOF mass spectrometric method for separating a spectrum of interest from detected overlapping spectra even if ions are ejected at so short intervals that the aforementioned overlap of spectra takes place.

This object is achieved in accordance with the teachings of the invention by a TOF mass spectrometer having an ion source from which ions are sequentially ejected as pulses. The pulsed ions are dispersed according to time of transit and detected, producing spectral signals. Timing pulse sequences are used to generate ions in the form of pulses sequentially. Deconvolution is performed according to the spectral signals and the timing pulse sequences. In this way, a spectrum arising from a singly ejected pulse is obtained.

In another embodiment of the invention, a pulse-generating means for producing two or more timing pulse sequences is used to ejections from the ion source. These timing pulse sequences do not assume zero point at the same frequency position when transformed into the frequency domain. Ions are ejected from the ion source in response to the timing pulse sequences, and their respective spectral signals are produced from the detector. Deconvolution is performed according to the spectral signals and signals indicative of the pulse sequences. In this way, a spectrum emanating from a singly ejected pulse is obtained.

Other objects and features of the invention will appear in the course of the description thereof, which follows.

DETAILED DESCRIPTION OF THE INVENTION

Figure 2:
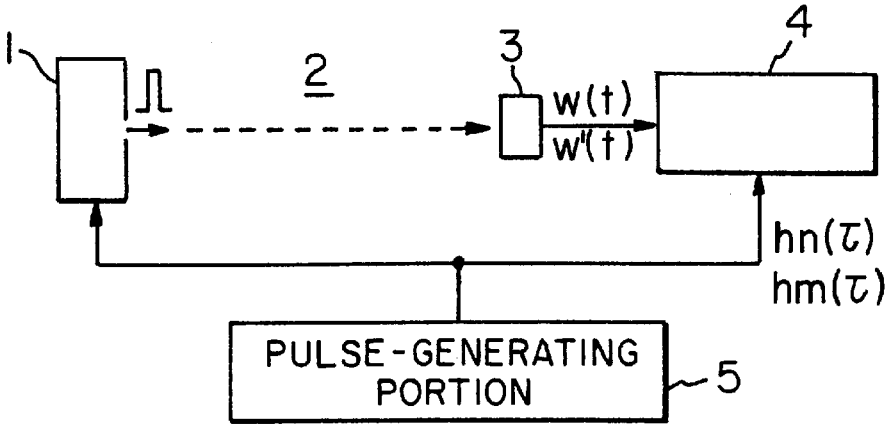
FIG. 2 is a schematic block diagram of a time-of-flight spectrometer in accordance with the invention.

Referring to FIG. 2, there is shown a time-of-flight (TOF) mass spectrometer in accordance with the present invention. This instrument comprises an ion source 1, a field-free drift region 2, a detector 3, an arithmetic unit 4, and a pulse-generating portion 5. When one pulse is supplied from the pulse-generating portion 5 to the ion source 1, an assemblage of ions accelerated by a given accelerating voltage are ejected in the form of pulses in a short time. The pulsed ions ejected from the ion source 1 are composed of sample ions of different masses. Since they are accelerated by a given accelerating voltage, they have flight velocities according to their masses. In particular, ions having greater masses have smaller flight velocities, and ions having smaller masses have greater flight velocities.

The ions ejected from the ion source with flight velocities according to their masses in this way are spatially dispersed according to their flight velocities during travel through the drift region 2. Ions having the minimum mass first arrive at the detector 3. Then, ions having greater masses sequentially impinge on the detector. Finally, ions of the maximum mass reach the detector.

Thus, one run of mass analysis according to the single assemblage of ions is completed.

The arithmetic unit 4 starts counting time on receiving pulses from the pulse-generating portion 5. Ion intensities detected by the detector 3 are recorded as a function of the elapsed time from the ejection from the ion source. In consequence, a mass spectral signal that expresses the relation of ion current to time is obtained.

A first embodiment of the invention is described now. It is now assumed that the pulse-generating portion 5 produces two timing pulses $p_1$ and $p_2$ at an interval $t_1$. Each of these two timing pulses ejects an assemblage of ions.

Figure 1A:
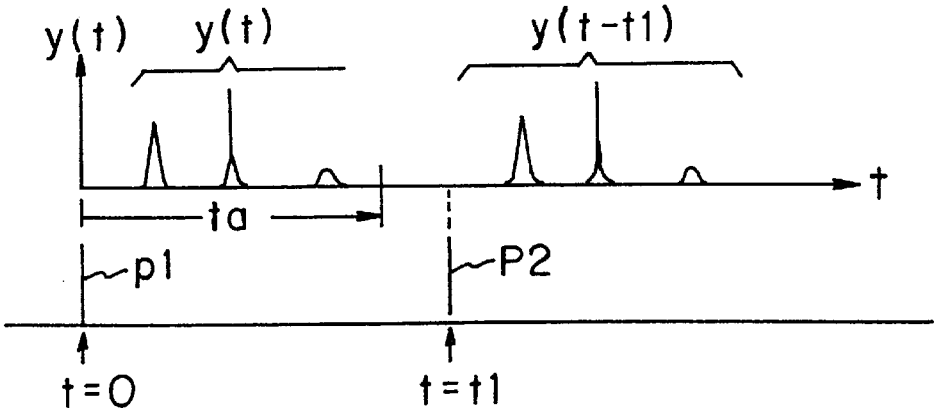
FIG. 1(a) PRIOR ART
FIG. 1(*a*) is a diagram illustrating a prior art mass spectrometric method and FIG. 1(*b*) is a diagram illustrating a mass spectrometric method effected by a time-of-flight mass spectrometer in accordance with the invention.
Figure 1B:
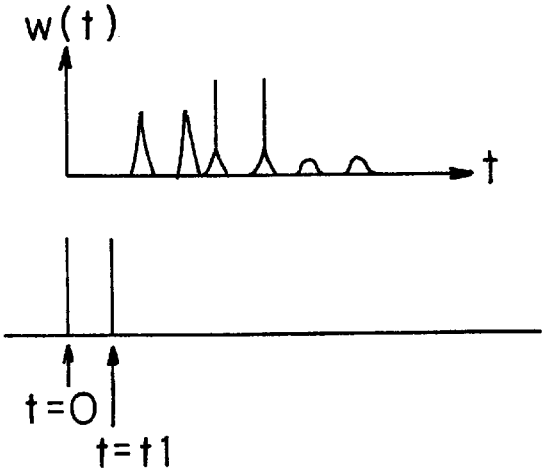

Let $t_a$ be an analysis time for an assemblage of ions. In the past, the relation $t_1>t_a$ has been selected. As shown in FIG. 1(*a*), two TOF spectra y(t) and $y(t-t_1)$ have been obtained from the detector without overlap.

On the other hand, in the present invention, the interval $t_1$ is so selected that $t_1<t_a$. The two TOF spectra y(t) and $y(t-t_1)$ overlap. The detector 3 produces a resultant spectrum w(t) as shown in FIG. 1(*b*). The resultant spectrum w(t) that is the sum of the two TOF spectra y(t) and $y(t-t_1)$ is given by $$w(t)=y(t)+y(t-t_1)$$

This principle is extended. Timing pulses are produced at $t_0$, $t_1$, $t_2$, . . . , $t_n$. Each timing pulse induces an assemblage of ions. Using a spectrum y(t) obtained by ejecting ions with a single pulse, the resultant spectrum w(t) obtained at this time is given by $$w(t) = y(t-t_0) + y(t-t_1) + \ldots + y(t-t_n) \quad (1)$$
$$= \int_{-\infty}^{\infty} \{\delta(\tau-t_0) + \delta(\tau-t_1) + \ldots + \delta(\tau-t_n)\} y(\tau-t) d\tau$$
$$= \int_{-\infty}^{\infty} h_n(\tau) y(\tau-t) d\tau$$

where $$h_n(\tau)=\delta(\tau-t_0)+\delta(\tau-t_1)+\ldots+\delta(\tau-t_n) \quad (2)$$

where $\delta(\tau)$ is a delta function. The pulses of a timing pulse sequence for ejecting the ions may be spaced from each other equally or at random.

Eq. (1) indicates that the resultant spectrum w(t) is given by convolution of two functions $h_n(\tau)$ and $y(\tau-t)$. When the Fourier-transforms of both sides of Eq. (1) are taken, the convolution of the functions is given by multiplication in Fourier transform algorithm. Thus, we have $$W(\omega)=H_n(\omega)\cdot Y(\omega) \quad (3)$$

where where $$W(\omega) = \int_{-\infty}^{\infty} w(t) e^{-i\omega t} dt$$
$$H_n(\omega) = \int_{-\infty}^{\infty} h_n(t) e^{-i\omega t} dt$$
$$Y(\omega) = \int_{-\infty}^{\infty} y(t) e^{-i\omega t} dt$$

$W(\omega)$ is known because it is the Fourier-transform of the detected resultant spectrum. As can be seen from Eq. (2), $H_n(\omega)$ is determined by the instants at which ions are ejected, i.e., $t_0, t_1, t_2, \ldots, t_n$ and, therefore, $H_n(\omega)$ is also known. Therefore, $Y(\omega)$ is calculated:

$$Y(107)=W(\omega)/H_n(\omega) \quad (4)$$

The original spectrum y(t) can be found by taking the inverse Fourier transform of $Y(\omega)$. Thus, a first procedure for mass analysis by the TOF mass spectrometer in accordance with the invention has been described.

Where the first procedure is effected to perform a mass analysis, the TOF mass spectrometer shown in FIG. 1 operates in the manner described below. In the configuration of FIG. 2, the pulse-generating portion 5 produces appropriate pulse sequences. Each pulse sequence may consist of any number of pulses. Furthermore, the time interval between the successive pulses may be set at will.

The arithmetic unit 4 takes the Fourier transform of the resultant spectral signal w(t) from the detector 3 to find $W(\omega)$. Also, the arithmetic unit 4 takes the Fourier transform of the pulse sequence signal $h_n(\tau)$ to find $H_n(\omega)$.

The arithmetic unit 4 calculates Eq. (4) using the found $W(\omega)$ and $H_n(\omega)$. Consequently, the inverse Fourier transform of $Y(\omega)$ is taken to find the original spectrum y(t). Obviously, the detector 3 is required to detect ions until ions of the maximum mass of interest reach the detector 3 after ions are ejected by the final pulse.

As described above, this configuration can produce the original spectrum y(t). In the above description, Fourier transformation techniques are used to find the original spectrum y(t). Methods other than Fourier transformation techniques such as deconvolution may be employed. In summary, the original spectrum y(t) can be found by deconvolution by utilizing the fact that the resultant spectrum w(t) given by Eq. (1) is expressed by convolution of $h_n(t)$ and the original spectrum y(t).

A second procedure in accordance with the present invention is next described. In the first procedure described above, Eq. (4) is calculated. However, this is permitted only where $|H(\omega)|\neq 0$. At zero point of $H(\omega)$, i.e., a frequency position where the relation $|H(\omega)|=0$ occurs, Eq. (4) cannot be calculated. Therefore, it is impossible to recover the original spectrum y(t) completely. The second procedure is able to circumvent such a drawback with the first procedure.

Consider a situation where ions are ejected with two pulse sequences. In the same way as in the above-described procedure, it is assumed that the first pulse sequence consists of pulses occurring at $t_0, t_1, t_2, \ldots, t_n$ and that the second pulse sequence consists of pulses occurring at $t_0, t_1, t_2, \ldots, t_m'$. These two pulse sequences are so set that when they are transformed into the frequency domain by Fourier transformation or other technique, they do not assume zero point at the same frequency position. This is achieved by appropriately setting the time interval between the successive pulses of each pulse sequence.

Then, ions are ejected with each pulse sequence, and a spectral measurement is made. For example, ions are ejected with the first pulse sequence, and a spectral measurement is made. After completion of this measurement, ions are ejected with the second pulse sequence, followed by a spectral measurement.

Let w(t) be a spectrum obtained using the first pulse sequence. Let w'(t) be a spectrum derived using the second pulse sequence. The spectrum w(t) is given by Eq. (1) above. The spectrum w'(t) is given by $$w'(t) = \int_{-\infty}^{\infty} h_m(\tau) y(\tau-t) d\tau \quad (5)$$

where $$h_m(\tau)=\delta(\tau-t_0)+\delta(\tau-t_1')+\ldots+\delta(\tau-t_m') \quad (6)$$

Taking the Fourier transform of Eq. (5) results in $$(\omega)=H_m(\omega)-Y'(\omega) \quad (7)$$
$$W'(\omega)=H_m(\omega)\cdot Y'(\omega) \quad (7)$$

where $$W'(\omega) = \int_{-\infty}^{\infty} w(t) e^{-i\omega t} dt$$
$$H_m(\omega) = \int_{-\infty}^{\infty} h_m(t) e^{-i\omega t} dt$$
$$Y'(\omega) = \int_{-\infty}^{\infty} y(t) e^{-i\omega t} dt$$

Therefore, $$Y'(\omega)=W'(\omega)/H_m(\omega) \quad (8)$$

is calculated. It follows that the original spectrum y(t) is obtained by taking the inverse Fourier transform of Eq. (8). Obviously, Eq. (4) holds for the spectrum w(t) derived using the first pulse sequence.

Accordingly, the relation $Y(\omega)=Y'(\omega)$ should hold. However, as can be seen from the description provided thus far, in the vicinities of zero point of $H_n(\omega)$ and in the vicinities of zero point of $H_n(\omega)$, problems take place. Consequently, taking the weighted average $Y''(\omega)$ of $Y(\omega)$ and $Y'(\omega)$ results in $$Y(\omega)=\{D(\omega)Y(\omega)+D'(\omega)Y'(\omega)\}/\{D(\omega)+D'(\omega)\} \quad (9)$$

$D(\omega)$ and $D'(\omega)$ are functions that are continuous except at zero point. These functions are so set that $D(\omega)$ assumes zero point at the same frequency position as $H_n(\omega)$ and that $D'(\omega)$ takes zero point at the same frequency position as $H_m(\omega)$. As a simple example, the relations are established:

$$D(\omega)=|H_n(\omega)| \quad (10)$$

$$D'(\omega)=|H_m(\omega)| \quad (11)$$

Under this condition, data about the other is used near mutual zero points. Therefore, $Y''(\omega)$ does not suffer from the zero point problem.

The inverse Fourier transform of $Y''(\omega)$ found with Eq. (9) is calculated and taken as the original spectrum y(t). The spectrum obtained in this way is much better in quality than a spectrum found by taking the inverse Fourier transforms of $Y(\omega)$ and $Y'(\omega)$ separately. Thus, the second procedure for mass analysis by a time-of-flight mass spectrometer in accordance with the invention has been described. It will be understood from the foregoing that the flight-of-time mass spectrometer performing a mass analysis by the second procedure described above can assume the following embodiment.

In the configuration shown in FIG. 2, the pulse-generating portion 5 can produce two pulse sequences. The number of pulses Forming each sequence may be set at will. Also, the pulse interval between successive pulses may be appropriately set. However, they are so set that they do not assume zero point at the same frequency position when transformed into the frequency domain.

First, the pulse-generating portion 5 produces the first pulse sequence to the ion source 1 and to the arithmetic unit 4. Then, a spectral measurement is made. After the completion of this measurement, the pulse-generating portion 5 produces the second pulse sequence to the ion source 1 and to the arithmetic unit 4, and then a spectral measurement is made.

The arithmetic unit 4 performs processing by following the procedure described below. When a spectral measurement is made from the detector 3. This signal is Fourier-transformed into $W(\omega)$. A signal indicative of the first pulse sequence $h_n(\tau)$ is Fourier-transformed into $H_n(\omega)$. $Y(\omega)$ is calculated from $H_n(\omega)$ and $W(\omega)$, using Eq. (4).

Then, a spectral measurement is made with the second pulse sequence. At this time, the arithmetic unit 4 Fourier-transforms the spectral signal w'(t) from the detector 3 into $W'(\omega)$ and transforms the second pulse sequence signal $h_m(\tau)$ into $H_m(\omega)$ Furthermore, the arithmetic unit 4 finds $Y'(\omega)$ from $W'(\omega)$ and $H_m(\omega)$, using Eq. (8).

Finally, the arithmetic unit 4 finds $D(\omega)$ and $D'(\omega)$ from $H_n(\omega)$ and $H_m(\omega)$, respectively. The arithmetic unit 4 finds the weighted average $Y''(\omega)$ from $D(\omega)$, $D'(\omega)$, $Y(\omega)$, and $Y'(\omega)$, using Eq. (9). The result is inverse-Fourier transformed, thus obtaining the original spectrum y(t).

In the description provided above, two pulse sequences are used. Obviously, more pulse sequences can be used. In addition, in the above description, Fourier transformation is utilized to find the original spectrum y(t). In the same way as in the first procedure, deconvolution can also be used.

While preferred embodiments of the present invention have been described, the invention is not limited thereto. Rather, various changes and modifications are possible. For example, in the description provided above, $h(\tau)$ is expressed as a sum of delta functions. This function is not limited to this form. In functions. This function is not limited to this form. In particular, where the pulse width of outgoing pulses is finite, it is obvious for those skilled in the art that the waveform of the outgoing pulses can be represented as it is without using delta function. In FIG. 2, the field-free drift region 2 permits ions to travel straight therethrough. This region may include a field that changes the direction of flight without varying the flight velocity such as a reflectron sector field.

As can be understood from the description provided thus far, the present invention makes it possible to separate and restore a spectrum y(t) that would normally be obtained by ejecting ions with a single pulse even if plural pulses are produced at short intervals of time to eject ions. Therefore, a spectral measurement can be made quickly and efficiently. The sensitivity can be improved. Furthermore, effective use of the ionized samples can be made.

What is claimed is:

1. A mass spectrometric method using a time-of-flight mass spectrometer having an ion source, a pulse-generating means for producing appropriate timing pulse sequences to eject pulsed ions from the ion source, a field through which the pulsed ions from the ion source travel while dispersed according to flight velocity, and a detector for detecting the dispersed ions, said mass spectrometric method comprising the steps of:

causing said pulse-generating means to produce two or more pulse sequences which, when transformed into a frequency domain, do not assume zero point at the same frequency position;

ejecting ions from said ion source in response to said pulse sequences produced from said pulse-generating means;

obtaining spectral signals w(t) and w'(t) from said detector when said ions are ejected from said ion source; and performing deconvolution using pulse sequence signals $h_n(\tau)$ and $h_m(\tau)$ produced from said pulse-generating means, thus obtaining a spectrum y(t) which would normally be produced when a single pulse is ejected from said ion source.

2. The method of claim 1, wherein said step of performing deconvolution comprises the steps of:

obtaining a spectral signal w(t) from said detector when a spectral measurement is made with a first pulse sequence;

Fourier-transforming said w(t) from the detector to find $W(\omega)$;

Fourier-transforming a signal $h_n(\tau)$ indicative of said first pulse sequence to find $H_n(\omega)$;

calculating $Y(\omega)=W(\omega)/H_n(\omega)$ from said $W(\omega)$ and $H_n(\omega)$ to find $Y(\omega)$;

obtaining a spectral signal w'(t) from said detector when a spectral measurement is made with a second pulse sequence;

Fourier-transforming said spectral signal w'(t) to find $W'(\omega)$;

Fourier-transforming a signal $h_m(\omega)$ indicative of said second pulse sequence to find $H_m(\omega)$;

performing calculation $Y'(\omega)=W'(\simeq)/H_m(\omega)$ from $W'(\omega)$ and $H_m(\omega)$ to find $Y'(\omega)$;

determining continuous functions $D(\omega)$ and $D'(\omega)$ that assume zero point at the same frequency positions as $H_n(\omega)$ and $H_m(\omega)$, respectively;

finding a weighted average $Y''(\omega)=\{D(\omega)Y(\omega)+D'(\omega)Y'(\omega)\}/\{D(\omega)+D'(\omega)\}$ from $D(\omega)$, $(\omega)$, $Y(\omega)$, and $Y'(\omega)$; and taking the inverse Fourier transform of the found weighted average $Y''(\omega)$ to find the original spectrum $y(t)$.

3. A time-of-flight mass spectrometer comprising:

an ion source;

a pulse-generating means for producing two or more pulse sequences to eject ions from said ion source, said two or more pulse sequences not assuming zero point at the same frequency position when transformed into a frequency domain;

a field through which the pulsed ions from said ion source travel while dispersed according to flight velocity;

a detector for detecting the dispersed ions and producing spectral signals when the ions are ejected from said ion source in response to said pulse sequences from said pulse-generating means; and an arithmetic means for performing deconvolution from said spectral signals and from the pulse sequences produced by said pulse-generating means to thereby find a spectrum that would normally be obtained with a singly ejected pulse.

4. The time-of-flight mass spectrometer of claim 3, wherein said step of performing deconvolution by said arithmetic means comprises the steps of:

obtaining a spectral signal $w(t)$ from said detector when a spectral measurement is made with a first pulse sequence;

Fourier-transforming said $w(t)$ from the detector to find $W(\omega)$,

Fourier-transforming a signal $h_n(\tau)$ indicative of said first pulse sequence to find $H_n(\omega)$;

calculating $Y(\omega)=W(\omega)/H_n(\omega)$ from said $W(\omega)$and $H_n(\omega)$ to find $Y(\omega)$;

obtaining a spectral signal $w'(t)$ from said detector when a spectral measurement is made with a second pulse sequence;

Fourier-transforming said spectral signal $w'(t)$ to find $W'(\omega)$;

Fourier-transforming a signal $h_m(\tau)$ indicative of said second pulse sequence to find $H_m(\omega)$;

performing calculation $Y'(\omega)=W'(\omega)/H_m(\omega)$ from $W'(\omega)$ and $H_m(\omega)$ to find $Y'(\omega)$;

determining continuous functions $D(\omega)$ and $D'(\omega)$ that assume zero point at the same frequency positions as $H_n(\omega)$ and $H_m(\omega)$, respectively;

finding a weighted average $Y''(\omega)=\{D(\omega)Y(\omega)+D'(\omega)Y'(\omega)\}/\{D(\omega)+D'(\omega)\}$ from $D(\omega)$, $D'(\omega)$, $Y(\omega)$, and $Y'(\omega)$; and taking the inverse Fourier transform of the found weighted average $Y''(\omega)$ to find the original spectrum $y(t)$.

* * * * *

UNITED STATES PATENT AND TRADEMARK OFFICE

CERTIFICATE OF CORRECTION

PATENT NO : 6,160,256
DATED : December 12, 2000
INVENTOR(S) : Morio Ishihara

It is certified that error appears in the above-identified patent and that said Letters Patent is hereby corrected as shown below:

Title Page, In the Title, "SING" should read --USING--.

Column 1 Line 3 "SING" should read --USING--.

Column 1 Line 25 "minimummass" should read --minimum mass--.

Column 1 Line 26 between "detector" and "Then" insert period (.).

Column 1 Line 35 between "sample" and "Consequently" insert period (.).

Column 1 Line 65 "ejections" should read --eject ions--.

Column 3 Line 29 delete "where" (duplicate text).

Column 3 Line 43, Equation (4), "Y(107)" should read --Y(ω)--.

Column 4 Line 20 "$t_0$, $t_1$, $t_2$" should read -- $t_0$, $t_1'$, $t_2'$--.

Column 4 Line 46 delete "$(\omega)=H_m(\omega)-Y'(\omega)$ (7)" .

Column 5 Line 32 "pulses Forming" should read --pulses forming--.

Column 5 Line 46 "detector 3. This" should read --detector 3, this--.

Column 5 Line 54 between "$H_m(\omega)$" and "Furthermore," insert period (.).

Column 6 Lines 4-5 after "to this form." delete "In functions. This function is not limited to this form."

UNITED STATES PATENT AND TRADEMARK OFFICE
CERTIFICATE OF CORRECTION

PATENT NO : 6,160,256
DATED : December 12, 2000
INVENTOR(S) : Morio Ishihara

It is certified that error appears in the above-identified patent and that said Letters Patent is hereby corrected as shown below:

Column 6 Line 61, Claim 2, "$h_m(\omega)$" should read --$h_m(\tau)$--.

Column 6 Line 63, Claim 2, "= $W'(\simeq)$ should read --= $W'(\omega)$--.

Column 8 Line 2, Claim 4, after "$W(\omega)$" delete comma (,) and insert semicolon (;).

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*